US012584194B2

(12) United States Patent
Schnitter et al.

(10) Patent No.: US 12,584,194 B2
(45) Date of Patent: Mar. 24, 2026

(54) LOW-OXYGEN ALSC ALLOY POWDERS AND METHOD FOR THE PRODUCTION THEREOF

(71) Applicant: TANIOBIS GMBH, Goslar (DE)

(72) Inventors: Christoph Schnitter, Holle (DE); Helmut Haas, Boerssum (DE); Holger Brumm, Goslar (DE)

(73) Assignee: TANIOBIS GMBH, Goslar (DE)

( * ) Notice: Subject to any disclaimer, the term of this patent is extended or adjusted under 35 U.S.C. 154(b) by 536 days.

(21) Appl. No.: 18/015,722

(22) PCT Filed: Jun. 24, 2021

(86) PCT No.: PCT/EP2021/067311
§ 371 (c)(1),
(2) Date: Jan. 12, 2023

(87) PCT Pub. No.: WO2022/012896
PCT Pub. Date: Jan. 20, 2022

(65) Prior Publication Data

US 2023/0272508 A1 Aug. 31, 2023

(30) Foreign Application Priority Data

Jul. 14, 2020 (DE) ..... 10 2020 208 782.2

(51) Int. Cl.

| | |
|---|---|
| ***C22C 1/04*** | (2023.01) |
| ***B22F 1/05*** | (2022.01) |
| ***B22F 9/20*** | (2006.01) |
| ***C22C 21/00*** | (2006.01) |

(52) U.S. Cl.
CPC ..... *C22C 1/0416* (2013.01); *B22F 1/05* (2022.01); *B22F 9/20* (2013.01); *C22C 21/00* (2013.01); *B22F 2301/052* (2013.01); *B22F 2304/10* (2013.01)

(58) Field of Classification Search
CPC ..... C22C 21/00; C22C 1/0416
See application file for complete search history.

(56) References Cited

U.S. PATENT DOCUMENTS

| | | | |
|---|---|---|---|
| 11,186,897 | B2 | 11/2021 | Mann et al. |
| 2011/0014107 | A1 | 1/2011 | Pai et al. |
| 2015/0275332 | A1 | 10/2015 | Haidar |
| 2018/0261439 | A1 | 9/2018 | Myasnikov et al. |
| 2020/0407863 | A1 | 12/2020 | Powell et al. |
| 2021/0246535 | A1 | 8/2021 | Mann et al. |

FOREIGN PATENT DOCUMENTS

| | | | |
|---|---|---|---|
| CN | 1699609 | A | 11/2005 |
| CN | 105189796 | A | 12/2015 |
| CN | 107532317 | A | 1/2018 |
| CN | 110540227 | A | 12/2019 |
| CN | 110756795 | A | 2/2020 |
| CN | 111647858 | A | 9/2020 |
| DE | 690 26 950 | T2 | 12/1996 |
| DE | 10 2011 111 365 | A1 | 2/2013 |
| EP | 0 395 472 | A1 | 10/1990 |
| EP | 3 287 548 | B1 | 1/2020 |
| RU | 2 387 725 | C2 | 1/2010 |
| RU | 2 665 857 | C2 | 9/2018 |
| RU | 2 717 441 | C1 | 3/2020 |
| WO | WO 97/07057 | A1 | 2/1997 |
| WO | WO 2014/138813 | A1 | 9/2014 |
| WO | WO 2019/083471 | A2 | 5/2019 |
| WO | WO 2019/178537 | A1 | 9/2019 |

OTHER PUBLICATIONS

W. W. Wendlandt: "The thermal decomposition of yttrium, scandium, and some rare-earth chloride hydrates", J. Inorg. Nucl. Chem., vol. 5, pp. 118-122 (1957).

ASTM B822-10: "Standard Test Method for Particle Size Distribution of Metal Powders and Related Compounds by Light Scattering", pp. 1-4 (2010).

*Primary Examiner* — Jessee R Roe
(74) *Attorney, Agent, or Firm* — Norman B. Thot

(57) ABSTRACT

An alloy powder which has a composition $Al_xSc_y$, where $0.1 \leq y \leq 0.9$ and $x=1-y$. The allow powder has purity of 99% by weight or more, based on metallic impurities, and an oxygen content of less than 0.7% by weight, based on a total weight of the alloy powder, as determined by a carrier gas hot extraction.

7 Claims, 5 Drawing Sheets

LOW-OXYGEN ALSC ALLOY POWDERS AND METHOD FOR THE PRODUCTION THEREOF

CROSS REFERENCE TO PRIOR APPLICATIONS

This application is a U.S. National Phase application under 35 U.S.C. § 371 of International Application No. PCT/EP2021/067311, filed on Jun. 24, 2021 and which claims benefit to German Patent Application No. 10 2020 208 782.2, filed on Jul. 14, 2020. The International Application was published in German on Jan. 20, 2022 as WO 2022/012896 A1 under PCT Article 21(2).

FIELD

The present invention relates to AlSc alloy powders which have a high purity and a low oxygen content, to processes for the production thereof, and the use thereof in the electronics industry and in electronic components.

BACKGROUND

Scandium is among the metals of the rare earths, the demand for which is steadily increasing, especially in ongoing development in the field of mobile communications technology, electromobility, and high-grade aluminum alloys having particular mechanical properties. As an alloy constituent, scandium is used together with aluminum as, for example, dielectric AlScN layers in BAW (bulk acoustic wave) filters, in electronic components in the electronics industry, and for wireless transmission such as WLAN and mobile communications. For this purpose, an AlSc sputtering target is firstly made from an AlSc alloy powder or the elements, and this is then used for producing the dielectric layers.

The fields of use in which AlSc alloy powders are used all have the requirement that the alloy powders must have a high purity, which in the handling of scandium is made difficult by the fact that scandium forms a natural oxide layer in air. Scandium is also difficult to produce in metallic or alloyed form because of its very reactive character and its high affinity to oxygen. There is therefore a need for high-purity AlSc alloy powders and also processes for the production thereof.

AlSc alloys are generally obtained by reaction of the two metals with one another, with the scandium being able to be produced beforehand by reaction of $ScF_3$ with calcium. This method has the disadvantage, however, that, after removal as slag of the $CaF_2$ which is likewise formed, the scandium must be purified by sublimation at high temperatures, but that significant amounts of impurities nevertheless generally remain in the product and the scandium is additionally contaminated by the crucible material because of the high temperatures necessary.

The prior art describes some production processes in which scandium chloride is reacted with aluminum according to the following reaction equation to form $Al_3Sc$:

$$ScCl_3+4Al \rightarrow Al_3Sc+AlCl_3$$

In addition to the high air and hydrolysis sensitivity of $ScCl_3$, the method of production described has the disadvantage that a number of by-products, for example, scandium oxide ($Sc_2O_3$) or scandium oxychloride (ScOCl), which are due to decomposition of the starting material as described by W. W. Wendlandt in "*The thermal decomposition of Yttrium, Scandium, and some rare-earth chloride hydrates*", published in *J. Inorg. Nucl. Chem.*, 1957, Vol. 5, 118-122, are formed in addition to the target compound $Al_3Sc$. The decomposition of $ScCl_3*6H_2O$ thus leads to the formation of ScOCl and $Sc_2O_3$. In order to counter this disadvantage, a number of processes which concern the production of very pure anhydrous $ScCl_3$ are known.

WO 97/07057 A1 describes a process for producing essentially pure and anhydrous rare earth metal halides by dehydration of their hydrated salts, wherein the hydrated rare earth metal halides are introduced into a fluidized bed system comprising a reactor or a plurality of coupled reactors, and a gaseous desiccant is added at elevated temperature in order to obtain rare earth halides which have a particular maximum water content and are free of oxide impurities; no information about contamination with oxychlorides is, however, given.

EP 0 395 472 A1 describes dehydrated rare earth halides which have a water content in the range from 0.01 to 1.5% by weight and an oxyhalide content of less than 3% by weight. Dehydration is achieved by a gas stream containing at least one dehydrated halogenated compound being passed at a temperature of from 150 to 350° C. through a bed of the compound to be dehydrated. As dehydrated halogenated compounds, mention is made of hydrogen halides, halogens, ammonium halides, carbon tetrachloride, $S_2Cl_2$, $SOCl_2$, $COCl_2$, and mixtures thereof. The document provides no indication, however, that the process described would also be suitable for the production of scandium.

US 2011/0014107 A1 likewise describes a process for producing anhydrous rare earth metal halides in which a slurry is produced from the rare earth halide hydrate and an organic solvent, the slurry is heated under reflux, and the water is finally distilled off from the slurry.

CN 110540227 A describes a process for producing high-quality, anhydrous rare earth metal chlorides and bromides in which the hydrate of the rare earth metal halide $REX_3*xH_2O$ is firstly predried in order to obtain $REX_3$. The predried product is treated under water-isolating and oxygen-isolating conditions under reduced pressure and gradually heated up to 1500° C. in order to separate the $REX_3$ by sublimation from the oxidic by-products, which are likewise formed. A purity of 99.99% is reported for the rare earth halide obtained in this way. However, for the production of $ScCl_3$ in particular, the process has the disadvantage of a low yield because a number of oxidic by-products, such as scandium oxide ($Sc_2O_3$) or scandium oxychloride (ScOCl), are formed during predrying.

Even though processes for producing high-purity starting contents for the production of AlSc alloys are described in the prior art, how these can be converted into the desired AlSc alloys on an industrial scale with retention of a high purity has to date remained unknown.

In this context, WO 2014/138813 A1 describes a process for producing aluminum-scandium alloys from aluminum and scandium chloride in which scandium chloride is mixed with aluminum and then heated to temperatures of from 600 to 900° C., with the $AlCl_3$ formed being removed by sublimation. Apart from the target compound $Al_3Sc$, XRD images (FIG. 8) of the product show the formation of scandium metal and a slight contamination with $Sc_2O_3$; although this is not explicitly described, it can be seen from the unmarked reflections at 31.5 2Theta° (Cu) and at 33 2Theta° (Cu).

All the processes of the prior art generally produce $Al_3Sc$ having a comparatively high oxygen content and/or contents of the halides chlorine and/or fluorine, which greatly restricts the possible uses of these powders.

For this reason, there continues to be a need for high-purity aluminum-scandium alloys (AlSc alloys) which are suitable for use in the electronic industry and mobile communications technology, and also for a process for the production thereof.

SUMMARY

An aspect of the present invention is therefore to provide corresponding AlSc alloys which are suitable for the above-mentioned uses.

In an embodiment, the present invention provides an alloy powder which has a composition $Al_xSc_y$, where $0.1 \leq y \leq 0.9$ and $x=1-y$, a purity of 99% by weight or more, based on metallic impurities, and an oxygen content of less than 0.7% by weight, based on a total weight of the alloy powder, as determined by a carrier gas hot extraction.

BRIEF DESCRIPTION OF THE DRAWINGS

The present invention is described in greater detail below on the basis of embodiments and of the drawings in which.

DETAILED DESCRIPTION

Figure 1:
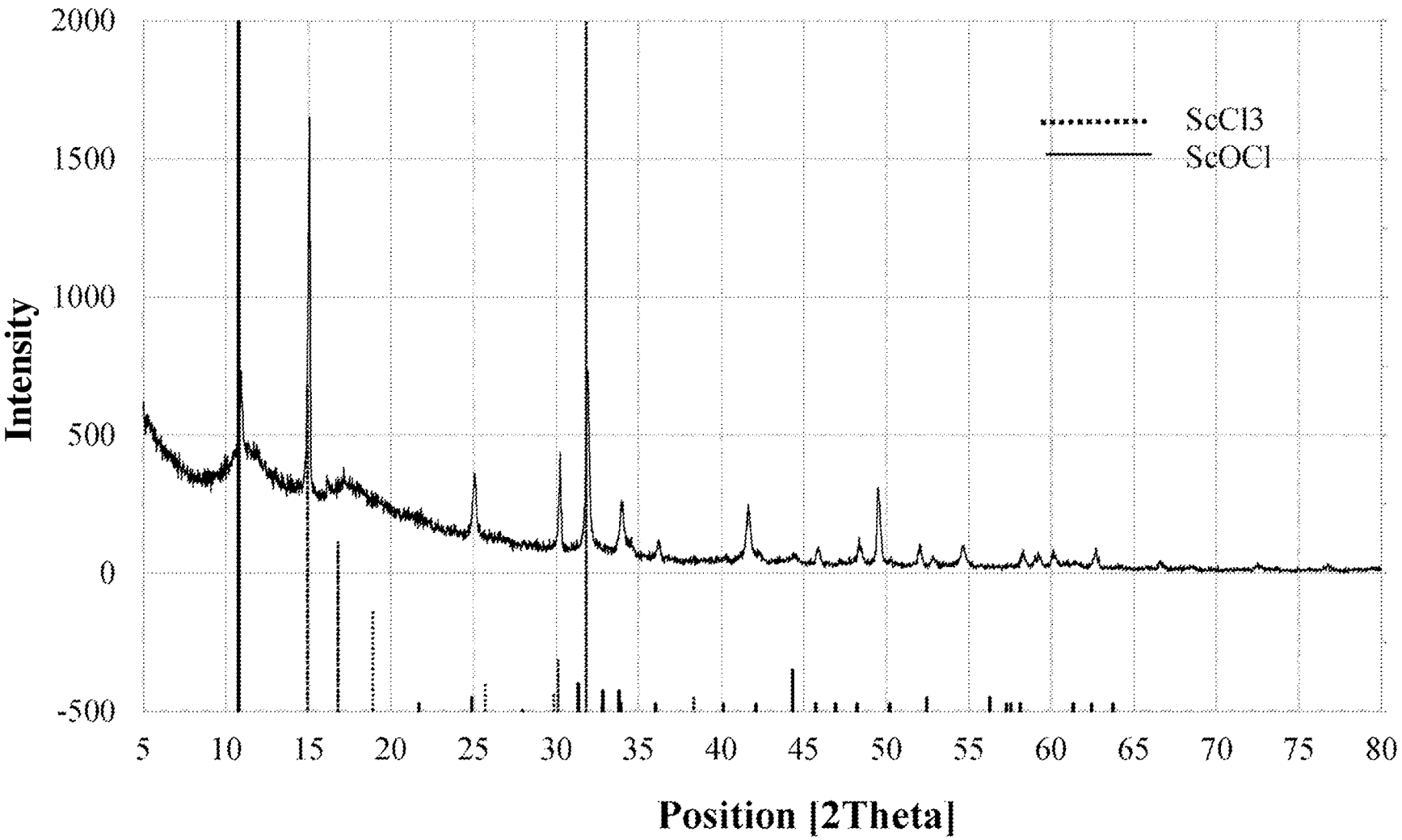
FIG. 1 shows an X-ray diffraction pattern of the $ScCl_3$ precursor P2.
Figure 2:
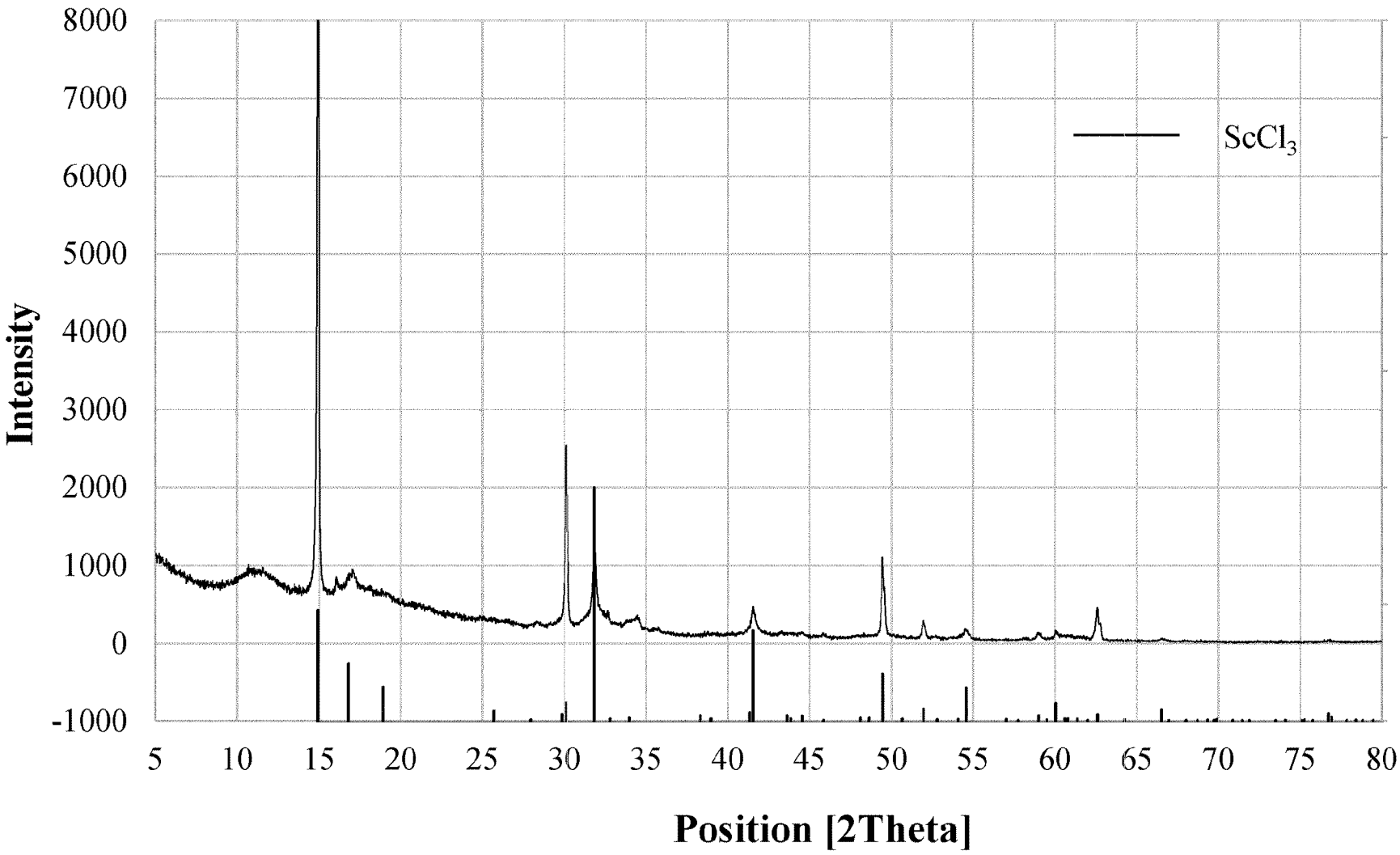
FIG. 2 shows an X-ray diffraction pattern of the $ScCl_3$ precursor P3.
Figure 3:
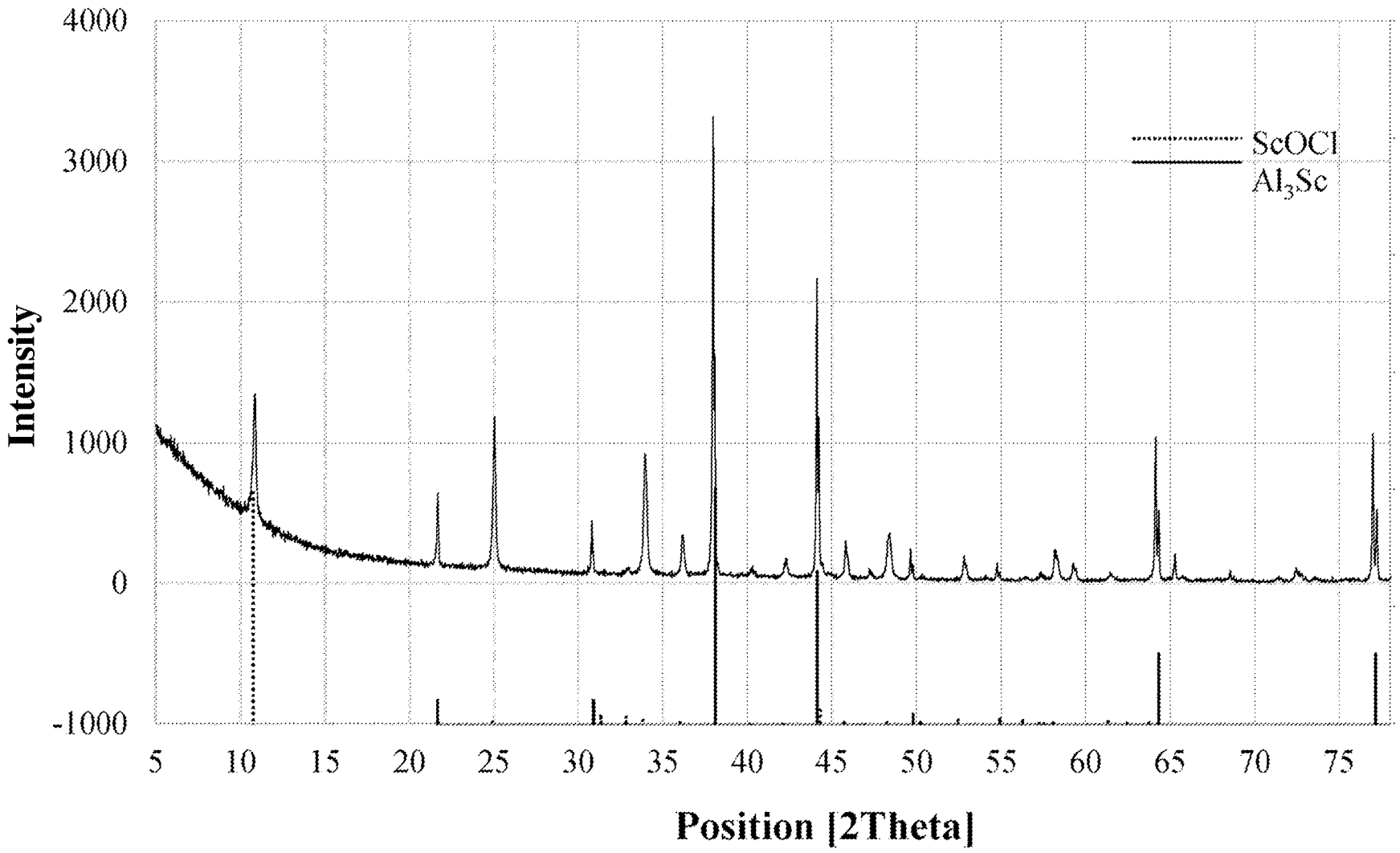
FIG. 3 shows an X-ray diffraction pattern of the AlSc alloy powder of Comparative Example C5.
Figure 4:
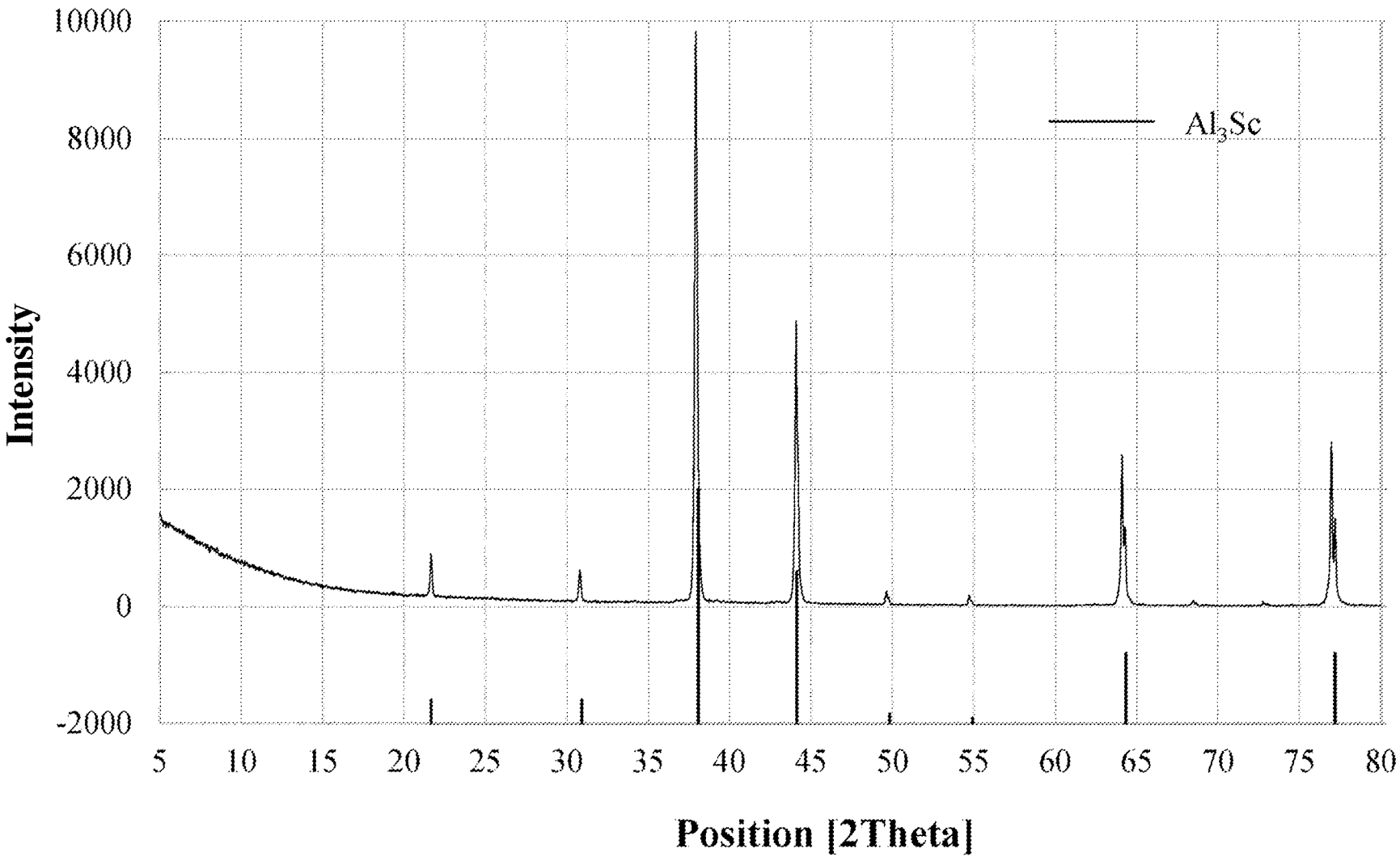
FIG. 4 shows an X-ray diffraction pattern of the AlSc alloy powder of Example E7 according to the present invention.
Figure 5:
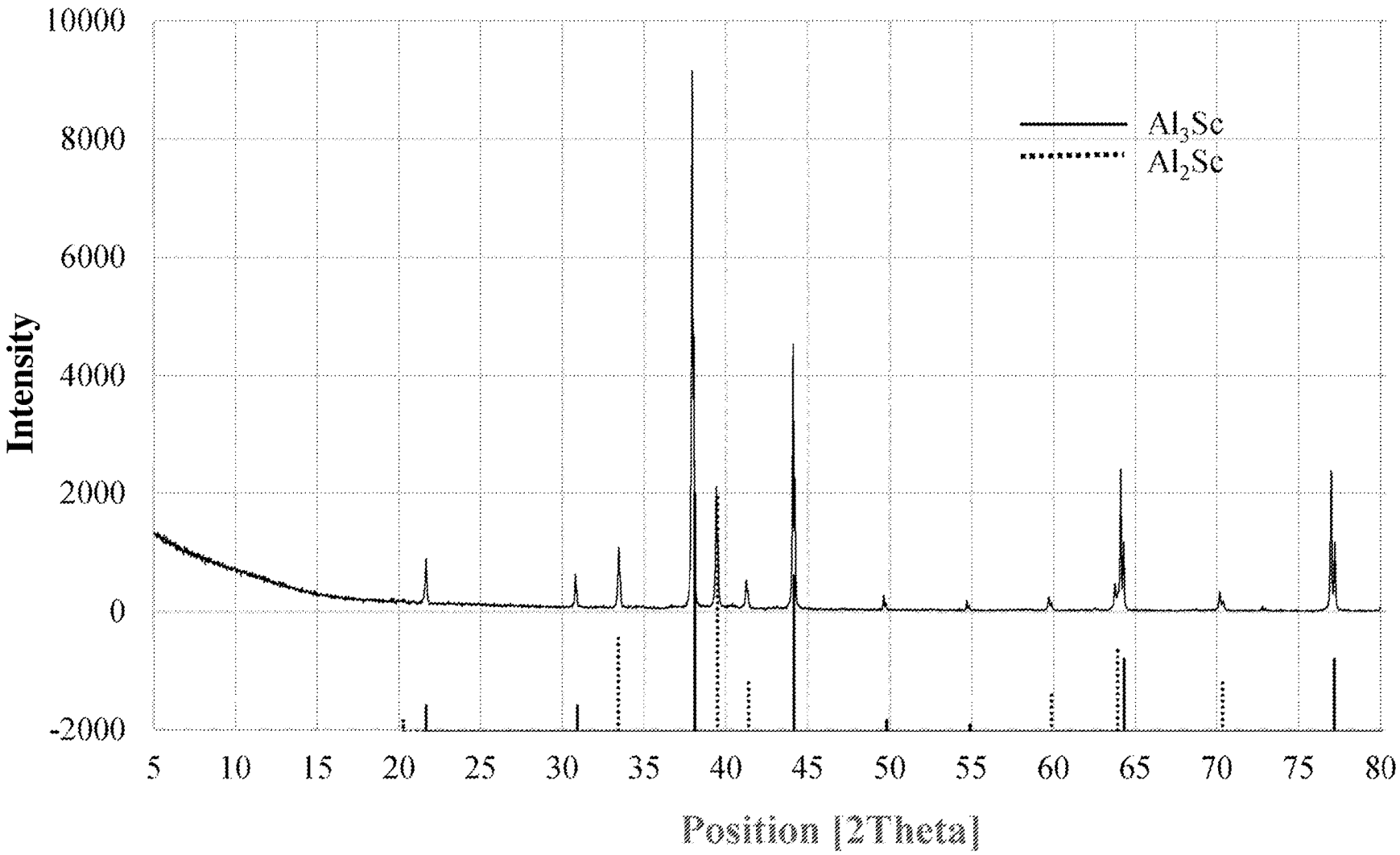
FIG. 5 shows an X-ray diffraction pattern of the AlSc alloy powder of Example E13 according to the present invention.

The present invention therefore firstly provides an alloy powder having the composition $Al_xSc_y$, where $0.1 \leq y \leq 0.9$ and $x=1-y$, determined via X-ray fluorescence analyses (XRF), and having a purity of 99% by weight or more, based on metallic impurities, wherein the alloy powder has an oxygen content of less than 0.7% by weight, based on the total weight of the powder, determined via carrier gas hot extraction.

In a particular embodiment, the alloy powder of the present invention has a composition $Al_xSc_y$, where $0.2 \leq y \leq 0.8$, for example, $0.24 \leq y \leq 0.7$, in each case with $x=1-y$, determined via X-ray fluorescence analyses (XRF). The alloy powder can also comprise mixtures of $Al_xSc_y$ of different compositions. The alloy powder of the present invention can, for example, have the composition $Al_3Sc$ ($x=0.75$; $y=0.25$) or $Al_2Sc$ ($x=2/3$; $y=1/3$) and any mixtures thereof.

In a further embodiment, the alloy powder of the present invention can, for example, have a purity of 99.5% or more, for example, 99.9% by weight or more, in each case based on the metallic impurities.

The powder of the present invention is in particular characterized by its low oxygen content. The alloy powder can, for example, have an oxygen content of less than 0.5% by weight, for example, less than 0.1% by weight, for example, less than 0.05% by weight, in each case based on the total weight of the powders. The oxygen content of the powder can be determined via carrier gas hot extraction.

It has surprisingly been found that the powders of the present invention are particularly suitable for applications in which a high purity is required. Apart from the low oxygen content, it has surprisingly been found that the powder also has the low chloride content which is essential for the electronics industry. For this reason, in an embodiment, the alloy powder of the present invention can, for example, have a chlorine content of less than 1000 ppm, for example, less than 400 ppm, for example, less than 200 ppm, in particular less than 50 ppm, as determined via ion chromatography.

For the purposes of the present invention, "ppm" in each case means parts per million based on the total weight of the powder.

It has in practice been found that, in particular, metallic scandium and oxidic and halogen-containing impurities lead to difficulties in further processing; these impurities can generally be detected via X-ray diffraction. These impurities are not only oxidic compounds of scandium, e.g., $Sc_2O_3$ and ScOCl, but also oxidic impurities which are introduced via the reactants used. In an embodiment of the present invention, an X-ray diffraction pattern of the alloy powder of the present invention does not, for example, have any reflections of compounds selected from the group consisting of $Sc_2O_3$, ScOCl, $ScCl_3$, Sc, $X_3ScF_6$, $XScF_4$, $ScF_3$ and other oxidic impurities and fluoridic foreign phases, where X is a potassium or sodium ion. The other oxidic impurities can, for example, be MgO, $Al_2O_3$, CaO and/or $MgAl_2O_4$.

In an embodiment, the alloy powder of the present invention can, for example, also have a magnesium content of less than 5000 ppm, for example, less than 2500 ppm, for example, less than 500 ppm, in particular less than 100 ppm, as determined via ICP-OES. In an embodiment, the alloy powder of the present invention can, for example, also have a content of calcium of less than 5000 ppm, for example, less than 2500 ppm, for example, less than 500 ppm, in particular less than 100 ppm, as determined via ICP-OES. In a further embodiment, the alloy powder of the present invention can, for example, have a content of sodium of less than 5000 ppm, for example, less than 2500 ppm, for example, less than 500 ppm, in particular less than 100 ppm, as determined via ICP-OES. For the purposes of the present invention, the terms "magnesium content", "sodium content", and "calcium content" encompass both the elements and the ions.

In an embodiment, the alloy powder of the present invention can, for example, also have a fluorine content of less than 1000 ppm, for example, less than 400 ppm, for example, less than 200 ppm, in particular less than 50 ppm, as determined via ion chromatography.

The alloy powder of the present invention is particularly suitable for further processing in the electronics industry, for example, as a precursor for the production of sputtering targets and also for the dielectrics layers produced therefrom, with not only a high purity, but also with the appropriate particle size here being of importance. For this reason, an embodiment of the alloy powder can, for example, have a particle size D90 of less than 2 mm, for example, from 100 μm to 1 mm, for example, from 150 μm to 500 μm, as determined in accordance with ASTM B822-10. The D90 of the particle size distribution is the particle size for which 90% by volume of the particles have a particle size equal to or smaller than the value indicated.

The present patent application further provides a process for producing the alloy powder of the present invention, where a scandium source is reacted with aluminum metal or an aluminum salt in the presence of a reducing agent to provide $Al_xSc_y$, where $0.1 \leq y \leq 0.9$, for example, $0.2 \leq y \leq 0.8$, for example, $0.24 \leq y \leq 0.7$, in each case with $x=1-y$. According to the present invention, the reducing agent is different from aluminum or an aluminum salt and does not comprise any aluminum. The aluminum salt can, for example, be a salt selected from the group consisting of $X_3AlF_6$, $XAlF_4$, $AlF_3$, $AlCl_3$, where X is a potassium or sodium ion. It has surprisingly been found that the formation of undesirable oxidic impurities can be avoided or significantly reduced by the process of the present invention and that AlSc alloy powders having a high purity and a low oxygen content are obtainable in this way.

While recourse must usually be made to $ScCl_3$ or Sc metal produced in a costly manner as a starting material in conventional production processes, the process of the present invention is characterized by the reaction also being able to occur starting from the oxides and oxychlorides of scandium and starting from $ScCl_3$ contaminated with ScOCl and/or $Sc_2O_3$, making the complicated dehydration or purification of the starting material, as described in the prior art, superfluous. In an embodiment of the process of the present invention, the scandium source can, for example, be selected from the group consisting of $Sc_2O_3$, ScOCl, $ScCl_3$, $ScCl_3*6H_2O$, $ScF_3$, $X_3ScF_6$, $XScF_4$, and mixtures of these compounds, where X is a potassium or sodium ion.

Alkali metals and alkaline earth metals have in particular been found to be suitable reducing agents in the process of the present invention. In an embodiment, the reducing agent can, for example, therefore be selected from the group consisting of lithium, sodium, potassium, magnesium and calcium, with, according to the present invention, in particular sodium and potassium being used in the reaction of the fluorides of scandium and magnesium and calcium being used in the reaction of the chlorides of scandium. The use of the reducing agents indicated has the advantage that the oxidation products of the reducing agent which are formed in the reduction, for example, MgO, $MgCl_2$ and NaF, can be easily removed by washing. In an embodiment, the process can, for example, further comprise a step in which the alloy powder obtained is washed. Distilled water and/or dilute mineral acids such as $H_2SO_4$ and HCl can, for example, be used for washing the powder.

It has surprisingly been found that the introduction of impurities can be reduced further when the reducing agent is introduced in the form of vapour. For this reason, an embodiment can, for example, provide that the reducing agent be used in the form of vapour.

It has found to be particularly effective for $ScCl_3$, ScOCl and/or $Sc_2O_3$ or mixtures thereof as the scandium source to be reacted with aluminum metal and magnesium as the reducing agent. It has here surprisingly been found that the purity of the AlSc alloy powder obtained can be increased further when the aluminum metal and the magnesium are prealloyed before the reaction. In an embodiment of the process of the present invention, aluminum metal and magnesium in the form of an Al/Mg alloy can, for example, be reacted with $ScCl_3$, ScOCl and/or $Sc_2O_3$ or mixtures thereof to provide $Al_xSc_y$, where $0.1 \leq y \leq 0.9$, for example, $0.2 \leq y \leq 0.8$, for example, $0.24 \leq y \leq 0.7$, in each case with $x=1-y$.

It has been found to be particularly advantageous for the aluminum metal and/or the Al/Mg alloy to be used in the form of a coarse powder, since the introduction of surface oxygen from these starting materials is thereby decreased and the oxygen contents of the alloy powder obtained can thereby be decreased further. In an embodiment, the aluminum metal and/or the Al/Mg alloy can, for example, be present in the form of a powder, where the powder can, for example, have an average particle size D50 of greater than 40 μm, for example, from 100 μm to 600 μm, and has a D90 of greater than 300 μm, for example, from 500 μm to 2 mm, as determined via ASTM B822-10. The D90 value of the particle size distribution is the particle size for which 90% by volume of the particles have a size which is equal to or less than the value indicated; correspondingly, the D50 value is the particle size for which 50% by volume of the particles have a size which is equal to or less than the value indicated.

In an embodiment, the process of the present invention can, for example, be carried out at significantly lower temperatures than are customary in the prior art, as a result of which inclusions of the oxidized reducing agent, for example, $MgCl_2$ or MgO, in the alloy powder can be avoided and the purity of the powder can thereby be increased. This applies particularly to the use of Al/Mg alloy because of the melting point lowering in alloy formation from Al and Mg which is here observed. In an embodiment of the process of the present invention, the reaction can, for example, be carried out at a temperature of from 400 to 1050° C., for example, from 400 to 850° C., for example, from 400 to 600° C. The reaction time here can, for example, be from 0.5 to 30 hours, for example, from 1 to 24 hours.

Particularly in cases in which aluminum metal and magnesium are used together with $ScCl_3$ as scandium source, it has been found to be advantageous for the reactants to be vaporized separately and then combined in the form of vapour in a reaction space. In this way, the oxidic impurities of the starting material can be separated off before the reaction. In an embodiment, $ScCl_3$ and also aluminum metal and magnesium can, for example, be vaporized separately and then combined in the gaseous state in a reaction space and reacted to give an alloy powder having the composition $Al_xSc_y$, where $0.1 \leq y \leq 0.9$, for example, $0.2 \leq y \leq 0.8$, for example, $0.24 \leq y \leq 0.7$, in each case with $x=1-y$.

It has surprisingly been found in the context of the present invention that the AlSc alloy powders of the present invention are also obtainable from the fluoride salts of scandium. In an alternative embodiment of the process of the present invention, a scandium fluoride salt can, for example, be reacted together with aluminum metal or an aluminum salt in the presence of sodium or potassium to give an alloy powder having the composition $Al_xSc_y$, where $0.1 \leq y \leq 0.9$, for example, $0.2 \leq y \leq 0.8$, for example, $0.24 \leq y \leq 0.7$, in each case with $x=1-y$. The scandium fluoride salt can, for example, be selected from the group consisting of $ScF_3$, $XScF_4$, $X_3ScF_6$, and any combinations thereof, where X is potassium or sodium or a mixture thereof. The aluminum salt can, for example, be selected from the group consisting of $AlF_3$, $X_3AlF_6$ and $XAlF_4$, where X is a potassium or sodium ion.

The reduction can here be carried out either with intermingled reducing agents or with vaporous reducing agents. The reduction can also be carried out within a melt. The advantage of these alternatives according to the present invention is that the fluorides of scandium, unlike the chlorides, are stable and less hygroscopic in air and can be obtained by precipitation from aqueous solutions. They can therefore be handled in air, which makes their use in industrial processes considerably easier.

The process of the present invention allows for the production of particularly pure AlSc alloy powders which have a low oxygen content. The present invention therefore further provides an alloy powder having the composition $Al_xSc_y$, where $0.1 \leq y \leq 0.9$, for example, $0.2 \leq y \leq 0.8$, for example, $0.24 \leq y \leq 0.7$, in each case with $x=1-y$, as determined via X-ray fluorescence analyses (XRF), obtainable by the process of the present invention. The powder which can be obtained in this way can, for example, have an oxygen content of less than 0.7% by weight, for example, less than 0.5% by weight, for example, less than 0.1% by weight, and in particular less than 0.05% by weight, in each case based on the total weight of the powder and determined via carrier gas hot extraction. The powder obtained in this can, for example, have the above-described properties.

The alloy powders of the present invention have a high purity and low oxygen content and are therefore particularly suitable for use in the electronics industry. The present invention therefore further provides for the use of the alloy powder of the present invention in the electronics industry or in electronic components, in particular for the production of sputtering targets and BAW filters.

The present invention will be illustrated with the aid of the following examples, but these should in no event be interpreted as a restriction of the inventive concept.

EXAMPLES

1. Production of the Scandium Sources $ScCl_3$ and ScOCl Used (Precursors P1 to P5)

$ScCl_3$ was produced in a manner analogous to the prior art summarized Table 1. Here, $ScCl_3*6H_2O$ (purity $Sc_2O_3$/TREO 99.9%), obtainable from Shinwa Bussan Kaisha, Ltd., served as the starting material in each case.

P1: In the case of P1, the reaction was carried out at 720° C. in a stream of argon without addition of $NH_4Cl$ for 2 hours.

P2: P2 is based on Example 2 of EP 0 395 472 A1, but the $NdCl_3*6H_2O$ described there was replaced by the corresponding Sc compound, $ScCl_3*6H_2O$.

P3: P3 is based on Example 5 of CN 110540117 A, but the mixture of $LaCl_3*7H_2O/CeCl_3*7H_2O$ described there was replaced by the corresponding hydrate $ScCl_3*6H_2O$.

P4: As P4, use was made of phase-pure ScOCl which was produced by the thermal treatment of $ScCl_3*6H_2O$ in a stream of HCl gas in a fused silica tube at 900° C. for 2 hours without addition of $NH_4Cl$.

P5: As P5, use was made of $Sc_2O_3$ (purity $Sc_2O_3$/TREO 99.9%) obtainable from Shinwa Bussan Kaisha, Ltd.

The phase compositions determined from the X-ray diffraction pattern (XRD) for the respective products and also oxygen contents and residual contents of $H_2O$ are likewise reported in Table 1.

2. Comparative Experiments C1 to C7

For the comparative experiments C1 to C6, the scandium-containing precursors P1 to P5 were mixed as indicated in Table 2 with aluminum or magnesium powder and introduced into a ceramic crucible. The average particle size D50 of the aluminum powder used was 520 μm and that of the magnesium powder used was 350 μm. A thermal reaction in an argon atmosphere was subsequently carried out as indicated in Table 2. The respective reaction products were subsequently washed with dilute sulfuric acid, dried in a convection drying oven for at least 10 hours, and subsequently subjected to chemical analysis and X-ray diffraction examination. The results are likewise reported in Table 2.

For comparative experiment C7, Example 2 of WO 2014/138813 A1 was replicated using the precursor P3 ($ScCl_3$) and an aluminum powder having an average particle size D50 of 14 μm. After the reaction under conditions analogous to those there disclosed, a powder having the following properties was obtained:

X-ray diffraction (XRD): $Al_3Sc$

Chemical analysis: oxygen 0.81% by weight, C1 15000 ppm, F<50 ppm, Mg<10 ppm, Na<10 ppm, Ca<10 ppm X-ray fluorescence analysis (XRF): Al:Sc ratio=0.77:0.23

Particle size D50: 25 μm

The total of all metallic impurities (including Mg, Ca and Na) was found to be <500 ppm for all experiments.

3. Experiments According to the Present Invention a) E1 to E8

In a manner analogous to the comparative experiments C1 to C7, scandium-containing precursors P1 to P5 were mixed as indicated in Table 3 with pulverulent Al and Mg or an Al/Mg alloy (69% by weight of Al, 31% by weight of Mg) and introduced into ceramic crucibles for experiments E1 to E8. The average particle size D50 of the aluminum powder used was 520 μm, that of the magnesium powder was 350 μm, and that of the Al/Mg alloy was 380 μm. The thermal reactions were carried out within a steel retort through which argon was passed during the entire reaction time, as indicated in Table 3. The respective reaction products were subsequently washed with dilute sulfuric acid, dried in a convection drying oven for at least 10 hours, and subsequently subjected to chemical analysis and X-ray diffraction examination. The results are likewise reported in Table 3. The sodium and calcium content was in each case <10 ppm in all experiments. The total of all metallic impurities (including Mg, Ca and Na) was found to be <400 ppm in all experiments.

b) Experiments E9 to E34

The scandium- and aluminum-containing precursors were used in the ratios indicated in Table 3 and Table 4 and distributed over a finely perforated niobium sheet. This was located in a steel reduction vessel which had been filled with the amount of sodium required for the reaction plus an excess of 50% based on the stoichiometry. The niobium sheet was placed above the sodium and without direct contact with the sodium. The reaction was carried out within a steel retort through which argon was passed during the entire reaction time. The sodium was vaporized, as a result of which the precursors were reduced to elemental Sc and Al which were reacted in situ to give the target alloy.

After the reaction, the retort was carefully passivated with air and the steel reduction vessel was then removed. Sodium fluoride formed during the reaction was washed out of the reaction product using water, and the product was then dried at low temperatures. The calcium content was <10 ppm and the sodium content <50 ppm for all experiments. The total of all metallic impurities (including Mg, Ca and Na) was found to be <400 ppm for all experiments.

c) Experiments E35 to E42

The scandium- and aluminum-containing precursors were mixed (see Table 4) and introduced together with the amount of sodium required for the reaction, plus an excess of 5% based on the stoichiometry, into a niobium vessel. The reaction was carried out within a steel retort through which argon was passed during the entire reaction time. The precursors were reduced by the sodium to elemental Sc and Al which were reacted in situ to give the target alloy.

After the reaction, the retort was carefully passivated with air and the steel reduction vessel was then removed. Excess sodium was dissolved by reaction with ethanol and the remaining solid was washed with water. The sodium fluoride and/or sodium chloride was here washed out of the reaction product, and the product was then dried at low temperatures. The calcium content was <10 ppm for all experiments and the sodium content was <50 ppm. The total of all metallic impurities (including Mg, Ca and Na) was found to be <400 ppm for all experiments.

The oxygen content of the powders was determined via carrier gas hot extraction (Leco TCH600) and the particle sizes D50 and D90 were each determined via laser light scattering (ASTM B822-10, MasterSizer S, dispersion in water and Daxad 11.5 min ultrasonic treatment). Trace analysis of the metallic impurities was carried out via ICP-OES (optical emission spectroscopy with inductively coupled plasma) using the following analytical instruments PQ 9000 (Analytik Jena2) or Ultima 2 (Horiba) and the determination of the composition of the crystalline phases was carried out on pulverulent samples via X-ray diffraction (XRD) using an instrument from Malvern-PANalytical (X'Pert-MPD Pro with semiconductor detector, X-ray tubes Cu LFF with 40 KV/40 mA, Ni filter). The determination of the halides F and Cl was based on ion chromatography (ICS 2100). The instruments Axios and PW2400 from Malvern-PANalytical served for X-ray fluorescence analyses (XRF) of Al and Sc.

All contents of chemical elements reported in % are % by weight and are in each case based on the total weight of the powder. The purity in % by weight, in each case based on the metallic impurities, is the subtraction of all metallic impurities determined in % by weight from the 100% ideal value. The Al:Sc ratio is calculated from the contents of Al and Sc determined via XRF.

The abbreviation TREO stands for the total oxides of rare earth elements.

TABLE 1

Production of $ScCl_3$ Precursors

| Experiment number | Target product | Prior art | Production | Product XRD | Product O [%] | Product Residual $H_2O$ [%] |
|---|---|---|---|---|---|---|
| P1 | $ScCl_3$ | W. W. Wendlandt et al | Heating $ScCl_3*6H_2O$ to 720° C. in a stream of argon without addition of $NH_4Cl$ | ScOCl, $ScCl_3$ | 7.1 | 0.5 |
| P2 | $ScCl_3$ | EP 0395472 A1 | Analogous to Example 2, but $ScCl_3*6H_2O$ instead of $NdCl_3*6H_2O$ | $ScCl_3$, ScClO | 2.5 | 0.03 |
| P3 | $ScCl_3$ | CN 110540117 A | Analogous to Example 5, but $ScCl_3*6H_2O$ instead of $LaCl_3*7H_2O/CeCl_3*7H_2O$ mixture | $ScCl_3$ | 0.09 | 0.003 |

TABLE 2

Comparative Examples for the Production of AlSc Alloy Powders

| Experiment number | Sc precursor production | Amount of Sc precursor [g] | Al [g] | Mg [g] | Al/Mg alloy 69% by weight of Al/ 31% by weight of Mg [g] | Reaction temperature [° C.] | Reaction time [h] | Product XRD Result | Product XRF Al:Sc ratio | Product O [%] | Product C ppm | Product F ppm | Product Mg ppm |
|---|---|---|---|---|---|---|---|---|---|---|---|---|---|
| C1 | $Sc_2O_3$ (P5) | 200 | 0 | 210 | 0 | 950 | 3 | $Sc_2O_3$ | not able to be determined | 35.0 | <50 | <50 | 480 |
| C2 | $Sc_2O_3$ (P5) | 200 | 640 | 0 | 0 | 950 | 3 | $Sc_2O_3$ | not able to be determined | 34.9 | <50 | <50 | <10 |
| C3 | ScClO from P4 | 200 | 640 | 0 | 0 | 950 | 3 | ScClO | not able to be determined | 16.0 | 370 000 | <50 | <10 |
| C4 | $ScCl_3$ from P1 | 200 | 220 | 0 | 0 | 800 | 3 | $Al_3Sc$ + ScClO | — | 4.1 | 27 000 | <50 | <10 |
| C5 | $ScCl_3$ from P2 | 200 | 220 | 0 | 0 | 800 | 3 | $Al_3Sc$ + ScClO | — | 2.2 | 33 000 | <50 | <10 |
| C6 | $ScCl_3$ from P3 | 200 | 220 | 0 | 0 | 800 | 3 | $Al_3Sc$ | 0.77:0.23 | 0.75 | 12 000 | <50 | <10 |

TABLE 3

Examples According to the Present Invention for Production of AlSc Alloy Powders from $ScCl_3$ Precursors

| Experiment | Sc precursor production | Amount of Sc precursor [g] | Al [g] | Mg [g] | Al/Mg alloy 69% by weight of Al/ 31% by weight of Mg [g] | Na [g] | | Reaction temperature [ºC] | Reaction time [h] | Product XRD Result | Product XRF Al:Sc ratio | Product O [%] | Product Cl ppm | Product F ppm | Product Mg ppm | Product D90 μm |
|---|---|---|---|---|---|---|---|---|---|---|---|---|---|---|---|---|
| E1 | $Sc_2O_3$ from P5 | 200 | 0 | 0 | 680 | 0 | mixed | 500 | 3 | $Al_3Sc$ | 0.75:0.25 | 0.590 | <50 | <50 | <10 | 202 |
| E2 | ScClO from P4 | 200 | 0 | 0 | 680 | 0 | mixed | 500 | 3 | $Al_3Sc$ | 0.75:0.25 | 0.489 | 180 | <50 | <10 | 180 |
| E3 | $ScCl_3$ from P1 | 200 | 220 | 100 | 0 | 0 | mixed | 800 | 3 | $Al_3Sc$ | 0.75 0.25 | 0.410 | 185 | <50 | 266 | 420 |
| E4 | $ScCl_3$ from P1 | 200 | 0 | 0 | 320 | 0 | mixed | 500 | 3 | $Al_3Sc$ | 0.75:0.25 | 0.095 | <50 | <50 | 25 | 168 |
| E5 | $ScCl_3$ from P2 | 200 | 220 | 100 | 0 | 0 | mixed | 800 | 3 | $Al_3Sc$ | 0.75:0.25 | 0.310 | 168 | <50 | 401 | 550 |
| E6 | $ScCl_3$ from P3 | 200 | 220 | 100 | 0 | 0 | mixed | 800 | 3 | $Al_3Sc$ | 0.75:0.25 | 0.078 | 128 | <50 | 330 | 430 |
| E7 | $ScCl_3$ from P3 | 200 | 220 | 100 | 0 | 0 | mixed | 670 | 3 | $Al_3Sc$ | 0.75:0.25 | 0.049 | <50 | <50 | 94 | 358 |
| E8 | $ScCl_3$ from P3 | 200 | 0 | 0 | 320 | 0 | mixed | 500 | 3 | $Al_3Sc$ | 0.74:0.26 | 0.033 | <50 | <50 | 35 | 210 |
| E9 | $ScCl_3$ from P2 | 200 | 107 | 0 | 0 | 137 | gaseous | 750 | 4 | $Al_3Sc$ | 0.75:0.25 | 0.048 | <50 | <50 | <10 | 290 |
| E10 | $ScCl_3$ from P1 | 200 | 107 | 0 | 0 | 137 | gaseous | 750 | 4 | $Al_3Sc$ | 0.75:0.25 | 0.078 | <50 | <50 | <10 | 277 |
| E11 | $ScCl_3$ from P3 | 200 | 107 | 0 | 0 | 137 | gaseous | 750 | 4 | $Al_3Sc$ | 0.75:0.25 | 0.038 | <50 | <50 | <10 | 250 |
| E12 | $ScCl_3$ from P3 | 200 | 89 | 0 | 0 | 137 | gaseous | 750 | 4 | $Al_2Sc$. $Al_3Sc$ | 0.72:0.28 | 0.069 | <50 | <50 | <10 | 233 |
| E13 | $ScCl_3$ from P3 | 200 | 98 | 0 | 0 | 137 | gaseous | 750 | 4 | $Al_2Sc$, $Al_3Sc$ | 0.73:0.27 | 0.046 | <50 | <50 | <10 | 231 |
| E14 | $ScCl_3$ from P3 | 200 | 80 | 0 | 0 | 137 | gaseous | 750 | 4 | $Al_2Sc$, $Al_3Sc$ | 0.69:0.31 | 0.105 | <50 | <50 | <10 | 241 |

TABLE 4

Examples According to the Present Invention for Production of AlSc Alloy Powders from Sc Fluorides

| Experiment | Sc precursor production | Amount of Sc precursor [g] | Amount of Al precursor g | Na [g] | | Reaction temperature [ºC] | Reaction time [h] | Product XRD Result | Product XRF Al:Sc ratio | Product O [%] | Product Cl ppm | Product F ppm | Product Mg ppm | Product D90 μm |
|---|---|---|---|---|---|---|---|---|---|---|---|---|---|---|
| E15 | $Na_3ScF_6$/ $Na_3AlF_6$ | 200 Na3$ScF_6$ | 550 $Na_3AlF_6$ | 363 | gaseous | 750 | 4 | $Al_3Sc$ | 0.75:0.25 | 0.097 | <50 | <100 | <10 | 240 |
| E16 | $Na_3ScF_6$/ $Na_3AlF_6$ | 200 $Na_3ScF_6$ | 370 $Na_3AlF_6$ | 271 | gaseous | 750 | 4 | $Al_2Sc$ | 0.66:0.34 | 0.189 | <50 | <100 | <10 | 280 |
| E17 | $Na_3ScF_6$/ $Na_3AlF_6$ | 200 $Na_3ScF_6$ | 460 $Na_3AlF_6$ | 317 | gaseous | 750 | 4 | $Al_2Sc$. $Al_3Sc$ | 0.72:0.28 | 0.102 | <50 | <100 | <10 | 301 |
| E18 | $Na_3ScF_6$/ $Na_3AlF_6$ | 200 $Na_3ScF_6$ | 505 $Na_3AlF_6$ | 340 | gaseous | 750 | 4 | $Al_2Sc$. $Al_3Sc$ | 0.74:0.26 | 0.150 | <50 | <100 | <10 | 250 |
| E19 | $Na_3ScF_6$/ $Na_3AlF_6$ | 200 $Na_3ScF_6$ | 415 $Na_3AlF_6$ | 294 | gaseous | 750 | 4 | $Al_2Sc$. $Al_3Sc$ | 0.68:0.32 | 0.209 | <50 | <100 | <10 | 260 |
| E20 | $AlF_3$/$ScF_3$ | 200 $ScF_3$ | 495 $AlF_3$ | 811 | gaseous | 750 | 4 | $Al_3Sc$ | 0.74:0.26 | 0.044 | <50 | <100 | <10 | 180 |
| E21 | $AlF_3$/$ScF_3$ | 200 $ScF_3$ | 330 $AlF_3$ | 609 | gaseous | 750 | 4 | $Al_2Sc$ | 0.65:0.35 | 0.204 | <50 | <100 | <10 | 153 |
| E22 | $AlF_3$/$ScF_3$ | 200 $ScF_3$ | 415 $AlF_3$ | 710 | gaseous | 750 | 4 | $Al_2Sc$. $Al_3Sc$ | 0.73:0.27 | 0.134 | <50 | <100 | <10 | 181 |
| E23 | $AlF_3$/$ScF_3$ | 200 $ScF_3$ | 455 $AlF_3$ | 760 | gaseous | 750 | 4 | $Al_2Sc$. $Al_3Sc$ | 0.75:0.25 | 0.072 | <50 | <100 | <10 | 145 |
| E24 | $AlF_3$/$ScF_3$ | 200 $ScF_3$ | 375 $AlF_3$ | 660 | gaseous | 750 | 4 | $Al_2Sc$. $Al_3Sc$ | 0.69:0.31 | 0.133 | <50 | <100 | <10 | 175 |
| E25 | $Na_3ScF_6$/Al | 200 $Na_3ScF_6$ | 70 Al | 91 | gaseous | 750 | 4 | $Al_3Sc$ | 0.73:0.27 | 0.048 | <50 | <100 | <10 | 350 |

TABLE 4-continued

Examples According to the Present Invention for Production of AlSc Alloy Powders from Sc Fluorides

| Experiment | Sc precursor production | Amount of Sc precursor [g] | Amount of Al precursor g | Na [g] | | Reaction temperature [°C] | Reaction time [h] | Product XRD Result | Product XRF Al:Sc ratio | Product O [%] | Product Cl ppm | Product F ppm | Product Mg ppm | Product D90 μm |
|---|---|---|---|---|---|---|---|---|---|---|---|---|---|---|
| E26 | $Na_3ScF_6$/Al | 200 $Na_3ScF_6$ | 47 A | 91 | gaseous | 750 | 4 | $Al_2Sc$ | 0.69:0.31 | 0.292 | <50 | <100 | <10 | 365 |
| E27 | $Na_3ScF_6$/Al | 200 $Na_3ScF_6$ | 58 Al | 91 | gaseous | 750 | 4 | $Al_2Sc$. $Al_3Sc$ | 0.72:0.28 | 0.185 | <50 | <100 | <10 | 342 |
| E28 | $Na_3ScF_6$/Al | 200 $Na_3ScF_6$ | 53 Al | 91 | gaseous | 750 | 4 | $Al_2Sc$. $Al_3Sc$ | 0.74:0.26 | 0.064 | <50 | <100 | <10 | 329 |
| E29 | $Na_3ScF_6$/Al | 200 $Na_3ScF_6$ | 64 Al | 91 | gaseous | 750 | 4 | $Al_2Sc$. $Al_3Sc$ | 0.69:0.31 | 0.306 | <50 | <100 | <10 | 335 |
| E30 | $NaScF_4$/Al | 200 $Na_3ScF_6$ | 123 Al | 144 | gaseous | 750 | 4 | $Al_3Sc$ | 0.74:0.26 | 0.032 | <50 | <100 | <10 | 201 |
| E31 | $NaScF_4$/Al | 200 $Na_3ScF_6$ | 82 Al | 144 | gaseous | 750 | 4 | $Al_2Sc$ | 0.64:0.36 | 0.288 | <50 | <100 | <10 | 185 |
| E32 | $NaScF_4$/Al | 200 $Na_3ScF_6$ | 103 Al | 144 | gaseous | 750 | 4 | $Al_2Sc$. $Al_3Sc$ | 0.7:0.3 | 0.159 | <50 | <100 | <10 | 189 |
| E33 | $NaScF_4$/Al | 200 $Na_3ScF_6$ | 113 A1 | 144 | gaseous | 750 | 4 | $Al_2Sc$. $Al_3Sc$ | 0.75:0.25 | 0.044 | <50 | <100 | <10 | 209 |
| E34 | $NaScF_4$/Al | 200 $Na_3ScF_6$ | 93 Al | 144 | gaseous | 750 | 4 | $Al_2Sc$. $Al_3Sc$ | 0.71:0.29 | 0.233 | <50 | <100 | <10 | 195 |
| E35 | $Na_3ScF_6$/ $Na_3AlF_6$ | 200 $Na_3ScF_6$ | 550 $Na_3AlF_6$ | 254 | mixed | 750 | 4 | $Al_3Sc$ | 0.75:0.25 | 0.120 | <50 | <100 | <10 | 112 |
| E36 | $Na_3ScF_6$/ $Na_3AlF_6$ | 200 $Na_3ScF_6$ | 370 $Na_3AlF_6$ | 190 | mixed | 750 | 4 | $Al_2Sc$ | 0.64:0.36 | 0.381 | <50 | <100 | <10 | 131 |
| E37 | $AlF_3/ScF_3$ | 200 ScF | 495 $AlF_3$ | 568 | mixed | 750 | 4 | $Al_3Sc$ | 0.75:0.25 | 0.136 | <50 | <100 | <10 | 260 |
| E38 | $AlF_3/ScF_3$ | 200 $ScF_3$ | 330 $AlF_3$ | 426 | mixed | 750 | 4 | $Al_2Sc$ | 0.69:0.31 | 0.299 | <50 | <100 | <10 | 251 |
| E39 | $NaScF_4$/Al | 200 $Na_3ScF_6$ | 70 Al | 64 | mixed | 750 | 4 | $Al_3Sc$ | 0.74:0.26 | 0.211 | <50 | <100 | <10 | 321 |
| E40 | $NaScF_4$/Al | 200 $Na_3ScF_6$ | 47 Al | 64 | mixed | 750 | 4 | $Al_2Sc$ | 0.65:0.35 | 0.273 | <50 | <100 | <10 | 309 |
| E41 | $NaScF_4$/Al | 200 $Na_3ScF_4$ | 123 Al | 101 | mixed | 750 | 4 | $Al_3Sc$ | 0.76:0.24 | 0.085 | <50 | <100 | <10 | 150 |
| E42 | $NaScF_4$/Al | 200 $Na_3ScF_4$ | 82 Al | 101 | mixed | 750 | 4 | $Al_2Sc$ | 0.68:0.32 | 0.349 | <50 | <100 | <10 | 179 |

As can be seen from the data in Tables 3 and 4, the alloy powders of the present invention are distinguished not only by a low oxygen content, but also by a low chlorine and fluorine content, which is not achieved using the processes described in the prior art. The experiments presented also show that the process of the present invention also allows the production of high-purity AlSc alloy powder proceeding from the oxides, fluorides and chlorides of scandium, so that a complicated work-up of the starting materials can be dispensed with.

The X-ray diffraction patterns of the two AlSc alloy powders according to the present invention which are depicted are representative of all experiments E1 to E42 according to the present invention which have been described. As can be seen from a comparison of the patterns provided, the patterns of the powders according to the present invention do not show any further reflections in addition to those of the desired AlSc target compound.

The present invention is not limited to embodiments described herein; reference should be had to the appended claims.

What is claimed is:

1. An alloy powder comprising:

a composition $Al_xSc_y$, where $0.1 \leq y \leq 0.9$ and $x=1-y$;

a purity of 99% by weight or more, based on metallic impurities; and an oxygen content of less than 0.7% by weight, based on a total weight of the alloy powder, as determined by a carrier gas hot extraction, wherein the alloy powder has an X-ray diffraction pattern which has no reflection of Sc.

2. The alloy powder as recited in claim 1, further comprising:

a chlorine content of less than 1000 ppm, as determined by an ion chromatography.

3. The alloy powder as recited in claim 1, wherein the X-ray diffraction pattern also has no reflections of compounds selected from the group consisting of $Sc_2O_3$, ScOCl, $ScCl_3$, $Al_2O_3$, $X_3ScF_6$, $XScF_4$, $ScF_3$ and other oxidic and fluoridic foreign phases thereof, where X is a sodium ion or a potassium ion.

4. The alloy powder as recited in claim 1, further comprising:

a magnesium content of less than 5000 ppm, as determined by an ICP-OES.

5. The alloy powder as recited in claim 1, further comprising:

a particle size distribution D90 of less than 2 mm, as determined in accordance with ASTM B822-10.

6. The alloy powder as recited in claim 1, further comprising:

a fluoride content of less than 1000 ppm, as determined by an ion chromatography.

7. An alloy powder having a composition $Al_xSc_y$, where $0.1 \leq y \leq 0.9$ and $x=1-y$, wherein the alloy powder has an X-ray diffraction pattern which has no reflection of Sc.

* * * * *